US009945290B2

(12) United States Patent
Otsuji et al.

(10) Patent No.: US 9,945,290 B2
(45) Date of Patent: Apr. 17, 2018

(54) HANDHELD ENGINE-DRIVEN WORKING MACHINE

(71) Applicants: YAMABIKO CORPORATION, Ohme-shi, Tokyo (JP); IIDA DENKI KOGYO Co., Ltd., Mitaka-shi, Tokyo (JP)

(72) Inventors: Takamasa Otsuji, Ohme (JP); Shiro Yamaguchi, Ohme (JP); Kosuke Matsumoto, Ohme (JP); Hiroyuki Miyaki, Ohme (JP); Akira Yamazaki, Mitaka-shi (JP)

(73) Assignees: Yamabiko Corporation, Tokyo (JP); IIDA Denki Kogyo Co., Ltd., Tokyo (JP)

( * ) Notice: Subject to any disclaimer, the term of this patent is extended or adjusted under 35 U.S.C. 154(b) by 38 days.

(21) Appl. No.: 15/133,941

(22) Filed: Apr. 20, 2016

(65) Prior Publication Data

US 2016/0312692 A1 Oct. 27, 2016

(30) Foreign Application Priority Data

Apr. 24, 2015 (JP) ..... 2015-089631

(51) Int. Cl.
*F02B 63/02* (2006.01)
*F02D 41/24* (2006.01)
(Continued)

(52) U.S. Cl.
CPC ..... *F02B 63/02* (2013.01); *B27B 17/08* (2013.01); *F02D 31/009* (2013.01);
(Continued)

(58) Field of Classification Search
CPC ..... F02B 1/04; F02B 63/02; F02D 2400/06; F02D 19/081; F02D 31/007; F02D 35/0053; F02D 41/2451; F02M 17/00
See application file for complete search history.

(56) References Cited

U.S. PATENT DOCUMENTS 3,297,103 A * 1/1967 Walker ..... F02M 3/045 123/325
4,253,437 A * 3/1981 Haramoto ..... F02M 3/045 123/325

(Continued)

FOREIGN PATENT DOCUMENTS

JP 2013-204552 10/2013
WO 2007/133125 11/2007

OTHER PUBLICATIONS

European Search Report issued in European Patent Application No. 16166247.3 dated Oct. 4, 2016.

*Primary Examiner* — Long T Tran
(74) *Attorney, Agent, or Firm* — Baker Hostetler LLP

(57) ABSTRACT

An engine-driven working machine includes a controller, which varies a control value of a solenoid valve so as to decrease or increase an opening degree of the solenoid valve when a rotating speed of an engine is within a predetermined high rotating speed range and the rotating speed of the engine is lower or higher than a predetermined rotating speed, respectively. In case the controller determines that the engine-driven working machine gets started saw cutting, the controller stops varying the control value of the solenoid valve when the rotating speed of the engine is within the predetermined high rotating speed range and lower than the target rotating speed.

5 Claims, 10 Drawing Sheets

(51) Int. Cl.

| | |
|---|---|
| ***F02D 31/00*** | (2006.01) |
| ***F02D 35/00*** | (2006.01) |
| ***B27B 17/08*** | (2006.01) |
| ***F02D 41/08*** | (2006.01) |

(52) U.S. Cl.
CPC ..... *F02D 35/0069* (2013.01); *F02D 41/08* (2013.01); *F02D 41/2448* (2013.01); *F02D 2200/101* (2013.01); *F02D 2400/06* (2013.01)

(56) References Cited

U.S. PATENT DOCUMENTS

| | | | | |
|---|---|---|---|---|
| 4,401,080 | A * | 8/1983 | Otsuka | F02D 41/1489 123/492 |
| 5,611,312 | A * | 3/1997 | Swanson | F02M 1/02 123/179.18 |
| 8,074,623 | B2 * | 12/2011 | Carlsson | F02D 31/007 123/436 |
| 2011/0004395 | A1 | 1/2011 | Neubauer et al. | |
| 2013/0255629 | A1 * | 10/2013 | Yamashita | F02M 17/00 123/439 |

* cited by examiner

HANDHELD ENGINE-DRIVEN WORKING MACHINE

FIELD OF THE INVENTION

The present invention relates to a handheld engine-driven working machine, specifically, to a handheld engine-driven working machine having an electronically controlled carburetor, such as a chain saw, an engine cutter, and a hedge trimmer.

BACKGROUND OF THE INVENTION

An output power of an engine of a handheld engine-driven working machine, such as a chain saw, varies due to variations of a carburetor and an engine and usage circumstances (for example, a temperature, an atmospheric pressure, a moisture, and a kind of fuel). In order to operate the engine at a predetermined designed output power (predetermined air-fuel ratio), the handheld engine-driven working machine having an electronically controlled carburetor has been known, and such a carburetor has a solenoid valve for adjusting an amount of supplying fuel into the carburetor (for example, see the Patent Publication 1.). By changing a control value corresponding to an opening degree of the solenoid valve to adjust the amount of supplying fuel into the carburetor, the handheld engine-driven working machine can be operated at the predetermined designed output power.

Manufacturers of the handheld engine-driven working machines perform an operation with non-load (a completion operation) of the handheld engine-driven working machine before shipping it and provisionally determine the above-stated control value for operating the engine at the designed output power (a control value for completion operation V0). On the other hand, after shipping the handheld engine-driven working machine, a circumstance in which the handheld engine-driven working machine is actually used is different from a circumstance in which the completion operation is performed, and for example, a temperature, an atmosphere pressure, and a kind of fuel may vary. For this reason, in an operation under the usage circumstance (an actual operation), the above-stated control value for operating the engine at the designed output power (an actual operation control value) is different from the control value for completion operation V0. Thus, it is advantage that the actual operation control value is determined in the actual operation.

The Patent Publication 1 describes a handheld engine-driven working machine which automatically determines the actual operation control value. Briefly, the handheld engine-driven working machine is operated with non-load under a usage circumstance, and a PT control for a control value corresponding to an opening degree of the solenoid valve is performed so that a rotating speed of the engine when a throttle is fully opened becomes a target rotating speed. In the PI control, a PI calculation is performed by using a difference between a current rotating speed and the target rotating speed, and the control value is increased or decreased by a result of the PI calculation.

Specifically, after starting the engine, when the engine rotating speed is out of a predetermined engine rotating speed range, the PI control is not performed, and when the engine rotating speed is within the predetermined engine rotating speed range, the PI control is performed, Further, when the engine rotating speed is lower than the target rotating speed, the control value of the solenoid valve is varied so that the opening degree of the solenoid valve becomes smaller to make a fuel consumption lean, and when the rotating speed of the engine is higher than the target rotating speed, the control value of the solenoid valve is varied so that the opening degree of the solenoid valve becomes larger to make the fuel consumption rich. During a fixed number of continuous rotations, if the engine rotating speed is within a predetermined permissible range and the number of times of control implementations reaches a predetermined to number of times, the PI control is finished and the control value at the finishing is determined as the actual operation control value.

FIG. 9 is a graph showing changes in the engine rotating speed and the control value with respect to time around a time when the actual operation control value was determined in an example where the actual operation of the chain saw with non-load was performed while the control described in the Patent Publication 1 was performed. In this connection, the control value corresponding to the opening degree of the solenoid valve was determined so as to linearly change between 0 per mill (permillage) at a fully-opened solenoid valve and 1000 per mill at a fully-closed solenoid valve. Further, after starting the engine, the rotating speed of the engine was calculated per one rotation of the engine. Further, a racing operation was performed, in which an operation of fully opening the throttle for a several seconds and an operation of fully closing the throttle for a several seconds were alternately repeated.

In FIG. 9, after starting the engine, when the engine rotating speed was out of the predetermined rotating speed range (10500-14000 rpm) (A5), the PI control was not performed, and when it was within the predetermined rotating speed range (10500-14000 rpm) (B51, B52), the PI control was performed (C53). Further, when the rotating speed of the engine was within a range lower than the target rotating speed (12000 rpm) (B51), the control value was increased so that the opening degree of the solenoid valve was decreased to make the fuel consumption lean (C54), and when the rotating speed of the engine was within a range higher than the target rotating speed (12000 rpm) (B52), the control value was decreased so that the opening degree of the solenoid valve was decreased to make the fuel consumption rich (C55). During a predetermined number of times of continuous rotations (for example, 5000 times), when the engine rotating speed was within a predetermined range (for example, 11500-12500 rpm) and the control value did not become changing (C56), the PI control was finished and the control value at the finishing was determined as the actual operation control value. Concretely, in the third operation shown in FIG. 9, during 5000 rotations, when the engine rotating speed was within the predetermined range (12000±500 rpm) and the number of times of the control implementations reached a predetermined number of times (30 times) (C56), the PI control was finished (C53') and the control value at the finishing was determined as the actual operation control value.

In the example shown in FIG. 9, when the throttle was fully opened, the engine rotating speed was increased to approximate 12000 rpm substantially without overshooting (C51). When the throttle was returned, the engine rotating speed was decreased to an idling rotating speed (C52). The fluctuation of the engine rotating speed was relatively small after the engine rotating speed was increased.

In this connection, a control value determined by manufacturers of the handheld engine-driven working machines in the above-stated way before shipping is the control value for completion operation and is used as a basic value.

PRIOR ART PUBLICATION

Patent Publication 1: Japanese Patent Laid-open Publication No. 2013-204552

SUMMARY OF THE INVENTION

In the method described in the Patent Publication 1, the racing operation with non-load is required to be performed for a certain period before working. However, an operator on a field may not perform the racing operation with non-load for the period required for determining the above-stated control value, namely, may get started working with load soon.

The inventors of the present application examined how the control described in the Patent Publication 1 would be if a working with load is started within the period required for determining the control value. FIG. 10 is a graph showing changes in the engine rotating speed and the control value with respect to time around a time when the actual operation control value was determined in an example where an actual operation of a chain saw was performed with load while the control described in the Patent Publication 1 was performed.

In FIG. 10, when the throttle was fully opened, the engine rotating speed was increased beyond 12000 rpm (C61). Then, when the chain saw got started cutting wood and so on (with load), the engine rotating speed was decreased below 12000 rpm (C62), and maintained below 12000 rpm during the cutting. After the cutting is finished, the engine rotating speed was increased beyond 12000 rpm (C63), and when the throttle was returned, the engine rotating speed was decreased to an idling rotating speed (C64). In this situation, while the engine rotating speed was within a range of 10500-14000 rpm, the PI control was performed (C65). Namely, the control value was increased (C66) or decreased (C67) according to whether the rotating speed of the engine was smaller or larger than the target rotating speed, respectively. In the third operation shown in FIG. 10, the control value reached the maximum value (1000 per mill). In the fourth operation shown in FIG. 10, since during 5000 rotations, the engine rotating speed was within a predetermined range (12000±500 rpm) and the number of times of the control implementations reached a predetermined number of times (30 times) (C68), the PI control was finished (C65') and the control value at the finishing was determined as the actual operation control value.

As can be seen from FIG. 10, when the actual operation control value was determined in the operation with load, the control value was gradually increased, because the PI control, was performed when the chain saw cut wood and so on and while the engine rotating speed was decreased. In this case, since the rotating speed of the engine was too high, it would be possible for the engine to become a dangerous state, such as seizure. The engine rotating speed was actually limited to an upper limitation value of 14000 rpm to prevent such a dangerous state, but there were events in which the engine rotating speed reached the upper limitation value. Further, there were also events in which the control value reached the maximum value of 1000 per mill. As a result, the actual operation control value determined in FIG. 10 became relatively larger than the actual operation control value to be determined with non-load. Namely, the amount of supplying fuel to the carburetor was not proper. In this connection, since the upper limitation value of the engine rotating speed was set, as shown in FIG. 10, when the actual operation with non-load was performed after the actual operation control value was determined, fluctuation of the engine rotating speed might be large (C69). Further, since the control value cannot go beyond 1000 per mill, there is a possibility to be out of control, when the actual operation control value becomes close to 1000 per mill.

Thus, the object of the present invention is to provide a handheld engine-driven working machine, in which even if an operator starts a working operation with load without performing an operation with non-load for a certain period required for determining the control value, an actual operation control value can be obtained not so far from the actual operation control value to be determined with non-load, and permissible stable rotations with non-load can be obtained.

In order to achieve the above-stated object, a handheld engine-driven working machine according to the present invention comprises an engine including an electronically controlled carburetor; and a controller connected to the electronically controlled carburetor; wherein the electronically controlled carburetor includes a solenoid valve for adjusting an amount of supplying fuel into the electronically controlled carburetor, wherein the controller varies a control value of the solenoid valve so as to increase an opening degree of the solenoid valve when a rotating speed of the engine is within a predetermined high rotating speed range and higher than a predetermined rotating speed, wherein the controller varies the control value of the solenoid valve so as to decrease the opening degree of the solenoid valve when the rotating speed of the engine is within the predetermined high rotating speed range and lower than the predetermined rotating speed, and wherein in case the controller determines that the engine-driven working machine gets started saw cutting, the controller stops varying the control value of the solenoid valve when the rotating speed of the engine is within the predetermined high rotating speed range and lower than a target rotating speed.

In the prior art control, when the engine-driven working machine is saw cutting, namely, in a state with load, even if the engine rotating speed is decreased lower than the target rotating speed, the PT control is performed, which should be applied in a state with non-load. Then, when the PI control is continued, to be performed, the control value is gradually increased, and becomes relatively larger than a control value corresponding to the target rotating speed. As a result, when an operation with non-load is performed with the actual operation control value determined in the state with load, hunting of the engine rotating speed would be caused so that uncomfortable feeling may be given to an operator. On the contrary, in the handheld engine-driven working machine according to the present invention, the engine-driven working machine detects whether or not the engine-driven working machine gets started saw cutting. After the engine-driven working machine gets started saw cutting and when the rotating speed of the engine is lower than the predetermined rotating speed, the controller stops varying the control value of the solenoid valve so as to decrease the opening degree of the solenoid valve. This can reduce an adverse effect on the PI control. As a result, the actual operation control value determined in the state with load by the handheld engine-driven working machine according to the present invention is smaller than the actual operation control value determined in the state with load by the prior art handheld engine-driven working machine. Thus, when an operation with non-load is performed with the actual operation control value determined by the handheld engine-driven working machine according to the present invention, stable rotations in which fluctuation of the engine rotating speed is small can be obtained so that uncomfortable feeling does not given to the operator.

In an embodiment of the handheld engine-driven working machine according to the present invention, preferably, in case the controller determines that the engine-driven working machine gets started saw cutting, the controller maintains varying the control value of the solenoid valve so as is to increase the opening degree of the solenoid valve when the rotating speed of the engine is within the predetermined high rotating speed range and higher than the target rotating speed.

In an embodiment of the handheld engine-driven working machine according to the present invention, preferably, the controller determines that the engine-driven working machine gets started saw cutting, when a changing value of the rotating speed of the engine for one rotation of the engine is lower than a predetermined threshold value more than a predetermined number of times per a predetermined number of continuous rotations.

The handheld engine-driven working machine configured as stated above is advantageous for a case with relatively large load. Concretely, in case in which after fluctuation of the changing value of the engine rotating speed becomes large toward a negative direction due to an actuating part (for example, blades of the chain saw) of the engine-driven working machine contacting an object to be treated, the changing value of the engine rotating speed becomes small due to the actuating part mating with the object, and then the fluctuation of the changing value of the engine rotating speed becomes small due to a stable saw cutting state, it can be determined that the engine-driven working machine gets started saw cutting, when the changing value of the rotating speed of the engine for one rotation of the engine is lower than the predetermined threshold value more than the predetermined number of times per the predetermined number of continuous rotations.

In an embodiment of the handheld engine-driven working machine according to the present invention, preferably, the controller determines that the engine-driven working machine gets started saw cutting, when a changing value of the rotating speed of the engine for one rotation of the engine is within a predetermined range more than a predetermined number of times per a predetermined number of continuous rotations.

The handheld engine-driven working machine configured as stated above is advantageous for a case with relatively small load. Concretely, in case in which after fluctuation of the changing value of the engine rotating speed becomes slightly large toward a negative direction due to an actuating part (for example, blades of the chain saw) of the engine-driven working machine contacting an object to be treated, the fluctuation of the changing value of the engine rotating speed becomes small due to a stable saw cutting state at the same time the actuating part mates with the object, it can be determined that the engine-driven working machine gets started saw cutting, when the changing value of the rotating speed of the engine for one rotation of the engine is within the predetermined range more than the predetermined number of times per the predetermined number of continuous rotations.

In an embodiment of the handheld engine-driven working machine according to the present invention, preferably, the engine-driven working machine is a chain saw, an engine cutter or a hedge trimmer.

Effect of the Invention

According to the handheld engine-driven working machine according to the present invention, even if an operator gets started working with load without performing an operation with non-load for a certain period required for determining the control value, an actual operation control value can be obtained which is not so far from the actual operation control value to be determined with non-load, and permissible stable rotations with non-load can be obtained.

DETAILED DESCRIPTION OF EMBODIMENTS

Figure 1:
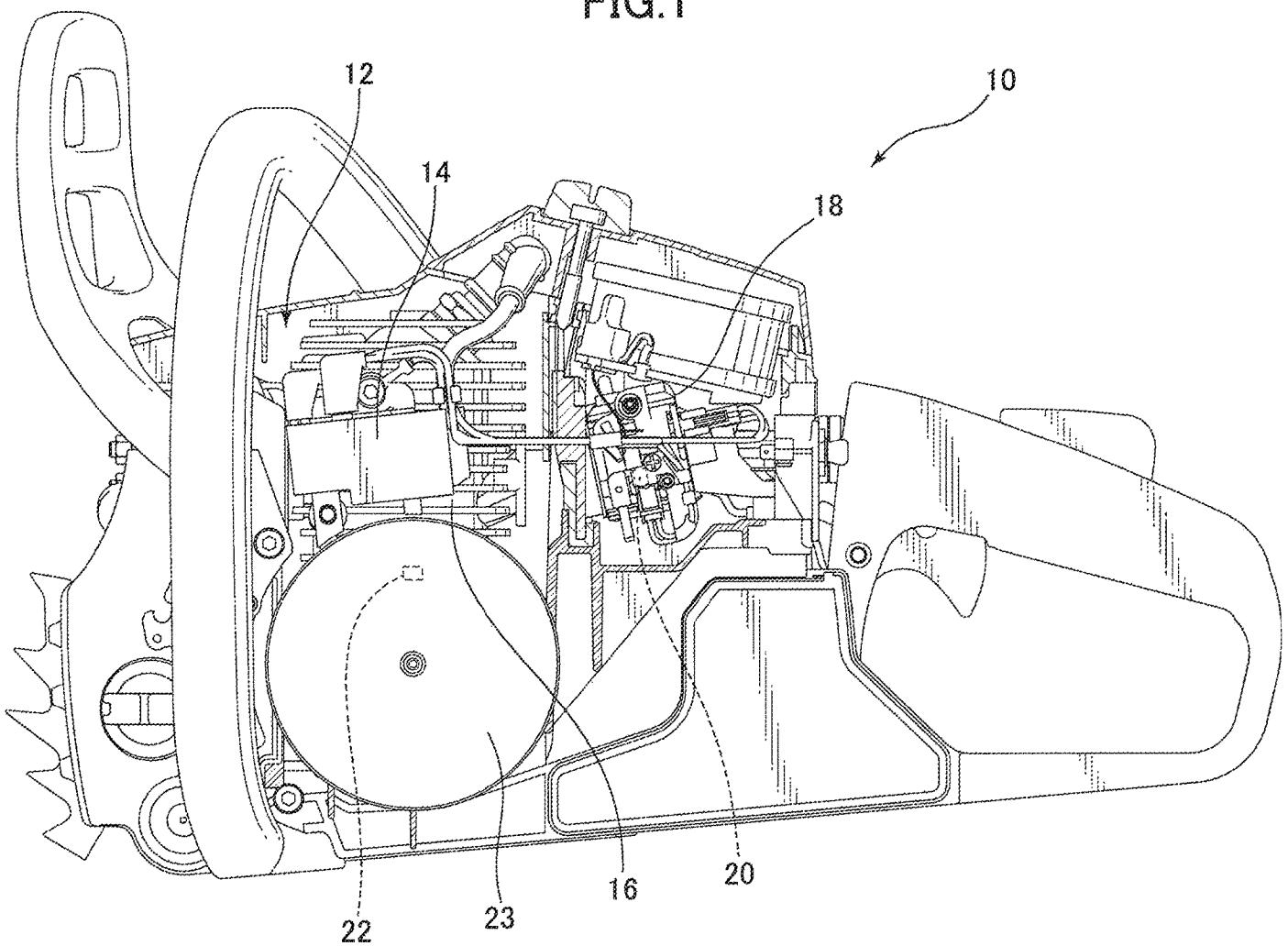
FIG. 1 is a side view of a chain saw according to the present invention in which a cover is omitted.

Referring to the drawings, an embodiment of a chain saw according to the present invention will be explained.

As shown in FIG. 1, a chain saw 10 has an engine 12 operated with gasoline fuel, and a controller 14 controlling the engine 12. The engine 12 has, at least, a cylinder block 16 and an electronically controlled carburetor 18. The carburetor 18 includes a solenoid valve 20 for adjusting an amount of supplying fuel into the carburetor 18, and the solenoid valve 20 is connected to the controller 14. Further, a detected object 22, such as a magnet, is attached to a flywheel 23, and the controller 14 is configured to detect the rotating speed of the engine 12 by using the detected object 22. Concretely, a period required for one rotation of the engine 12 is measured by detecting the detected object 22, and the rotating speed of the engine 12 is calculated per one rotation of the engine 12. In FIG. 1, chain blades are omitted.

Figure 2:
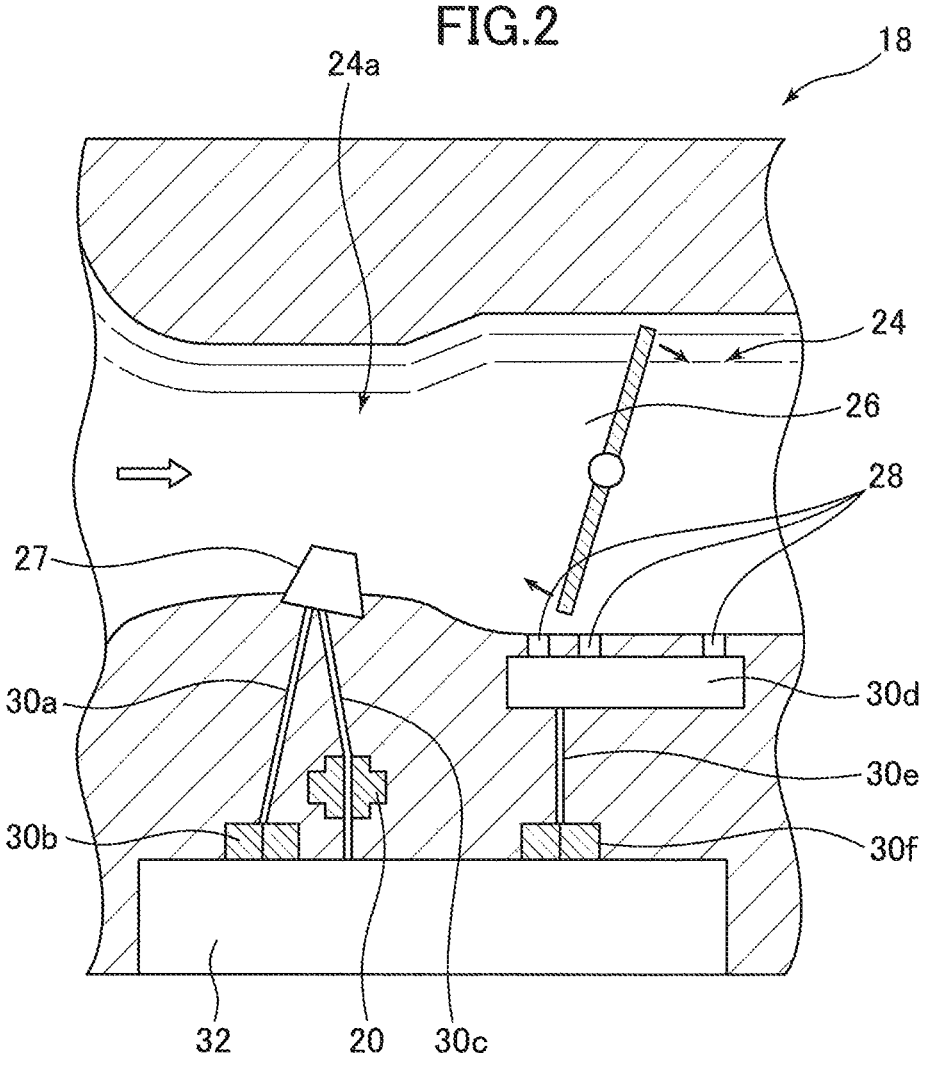
FIG. 2 is a schematic view showing an internal structure of a carburetor in the chain saw according to the present invention.

FIG. 2 is a schematic view showing an internal structure of the carburetor 18. As shown in FIG. 2, the carburetor 18 has a passage 24 including a Venturi section 24*a*, a throttle valve 26 provided in a passage downstream of the Venturi section 24*a*, a main fuel supply nozzle 27 disposed in the Venturi section 24*a*, and a slow-system (low speed) fuel supply port 28 disposed near the throttle valve 26. The main fuel supply nozzle 27 communicates with a metering chamber 32 through a first flow passage 30*a* and a fixed jet 30*b*, and communicates with a metering chamber 32 through a second flow passage 30*c* and the solenoid valve 20. The fuel supply port 28 communicates with the metering chamber 32 through a chamber 30*d*, a third flow passage 30*e* and the fixed jet 30*f*.

Fuel is supplied at a predetermined rate by a negative pressure of the engine through the main fuel supply nozzle 27 and the slow-system (low speed) fuel supply port 28. By adjusting an opening degree of the solenoid valve 20, an amount of fuel supplied through the main fuel supply nozzle 27 can be controlled, so that the entire amount of supplying fuel can be adjusted. In the present embodiment, a control value corresponding to the opening degree of the solenoid valve 20 is determined so as to linearly change between 0 per mill (permillage) when the solenoid valve 20 is fully opened and 1000 per mill when the solenoid valve 20 is fully closed.

Figure 3:
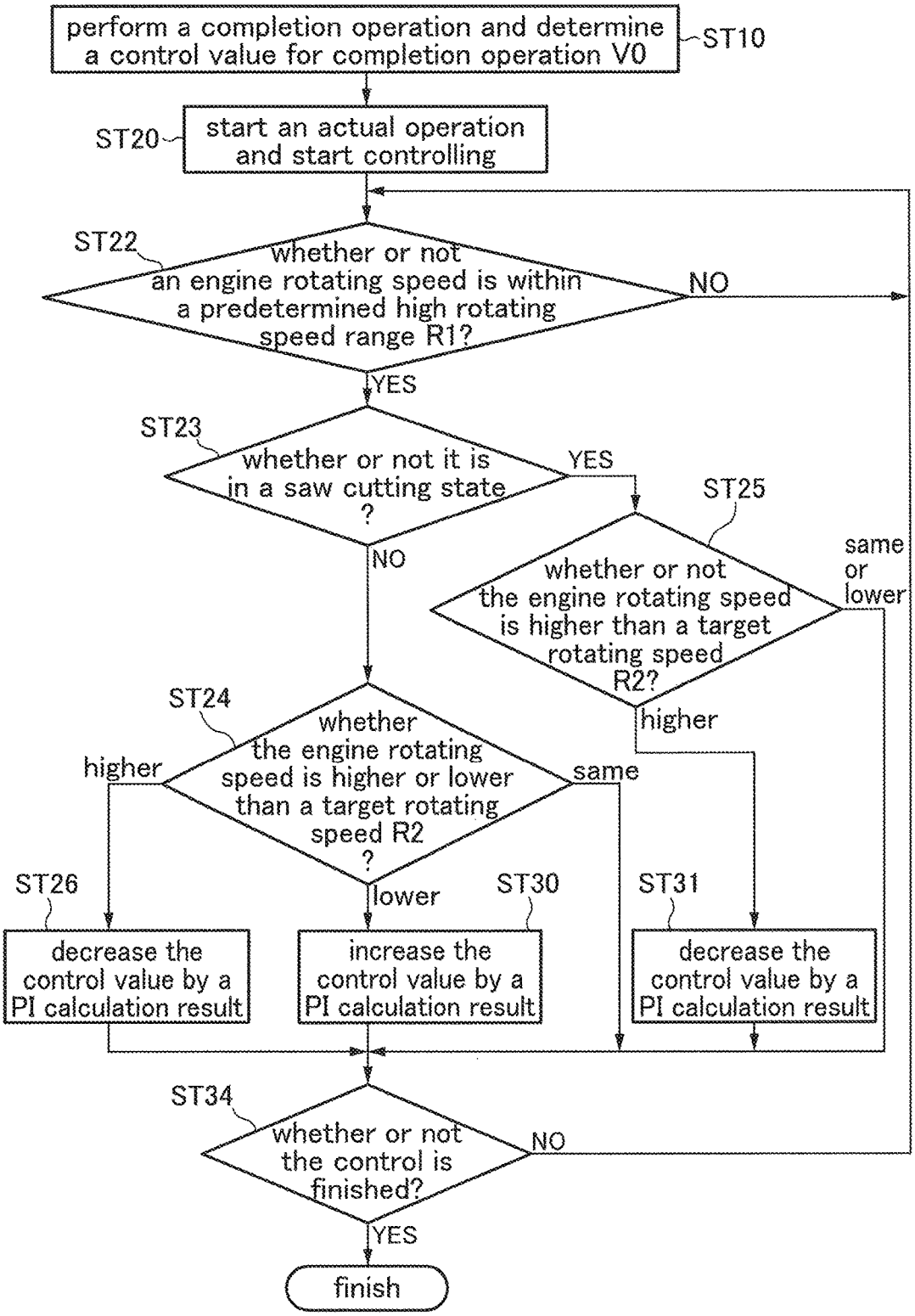
FIG. 3 is a flowchart showing a control method of the handheld engine-driven working machine according to the present invention.

FIG. 3 is a flow chart showing an embodiment of a control method of the handheld engine-driven working machine according to the present invention, and a chain saw which is an embodiment of the handheld engine-driven working machine will be explained from here.

In ST 10, a completion operation with non-load) is performed in a manufacturing factory with chain blades removed from the chain saw, and a control value for completion operation V0 is determined. Since a control method for determining the control value for completion operation V0 is the same as that for determining an actual operation control value with non-load, an explanation of the former control method is omitted.

In ST 20, an actual operation is started. Concretely, chain blades are attached to the chain saw, and under a circumstance where the working machine is actually used, the engine is started. As an initial value of the control value, the control value for completion operation V0 is used.

In ST 22, it is determined whether or not the rotating speed of the engine 12 is within a predetermined high rotating speed range R1 (for example, 10500-14000 rpm). If the answer is NO, the control is not performed and is returned to ST 22. If the answer is YES, the control is moved to ST23.

In ST 23, it is determined whether or not the chain saw is in a saw cutting state. When the answer is NO, the control is moved to ST 24.

When the answer is YES, the control is moved to ST 25, The determination whether or not the chain saw is in the saw cutting state will be explained later in detail.

When the chain saw is not in the saw cutting state, in ST 24, it is determined whether the rotating speed of the engine 12 is higher or lower than a target rotating speed R2 (for example, 12000 rpm).

When the rotating speed of the engine 12 is higher than the target rotating speed R2 (for example, 12000 rpm), in ST 26, the control value is decreased by the result of the PI calculation, so that the opening degree of the solenoid valve 20 is increased, and then the control is moved to ST 34.

When the rotating speed of the engine 12 is the target rotating speed R2 (for example, 12000 rpm), the control is moved to ST 34.

When the rotating speed of the engine 12 is lower than the target rotating speed R2 (for example, 12000 rpm), in ST 30, the control value is increased by the result of the PI calculation so that the opening degree of the solenoid valve 20 is decreased, and then the control is moved to ST 34.

When the chain saw is in the saw cutting state, in ST 25, it is determined whether the rotating speed of the engine 12 is higher or lower than the target rotating speed R2 (for example, 12000 rpm).

When the rotating speed of the engine 12 is higher than the target rotating speed R2 (for example, 12000 rpm), in ST 31, the control value is decreased by the result of the PI calculation so that the opening degree of the solenoid valve 20 is increased and then, the control is moved to ST 34.

When the rotating speed of the engine 12 equals to or is lower than the target rotating speed R2 (for example, 12000 rpm), the PI control is not performed, and then, the control is moved to ST 34. Namely, when the chain saw is in the saw cutting state, the control value is not increase so that the opening degree of the solenoid valve 20 is not decreased.

In ST 34, it is determined whether the control should be finished or not. For example, for a certain number of continuous rotations (for example, 5000 rotations), when the fluctuation of the rotating speed of the engine 12 is within a predetermined range (for example, within 1000 rpm) and a number of times of the control implementations reached a predetermined number of times (30 times), the control value at that time is determined as the actual operation control value, and then the control is finished. Otherwise, the control is returned to ST 22.

Next, the determination whether or not the chain saw according to the present invention is in the saw cutting operation state will be explained in detail.

Figure 4:
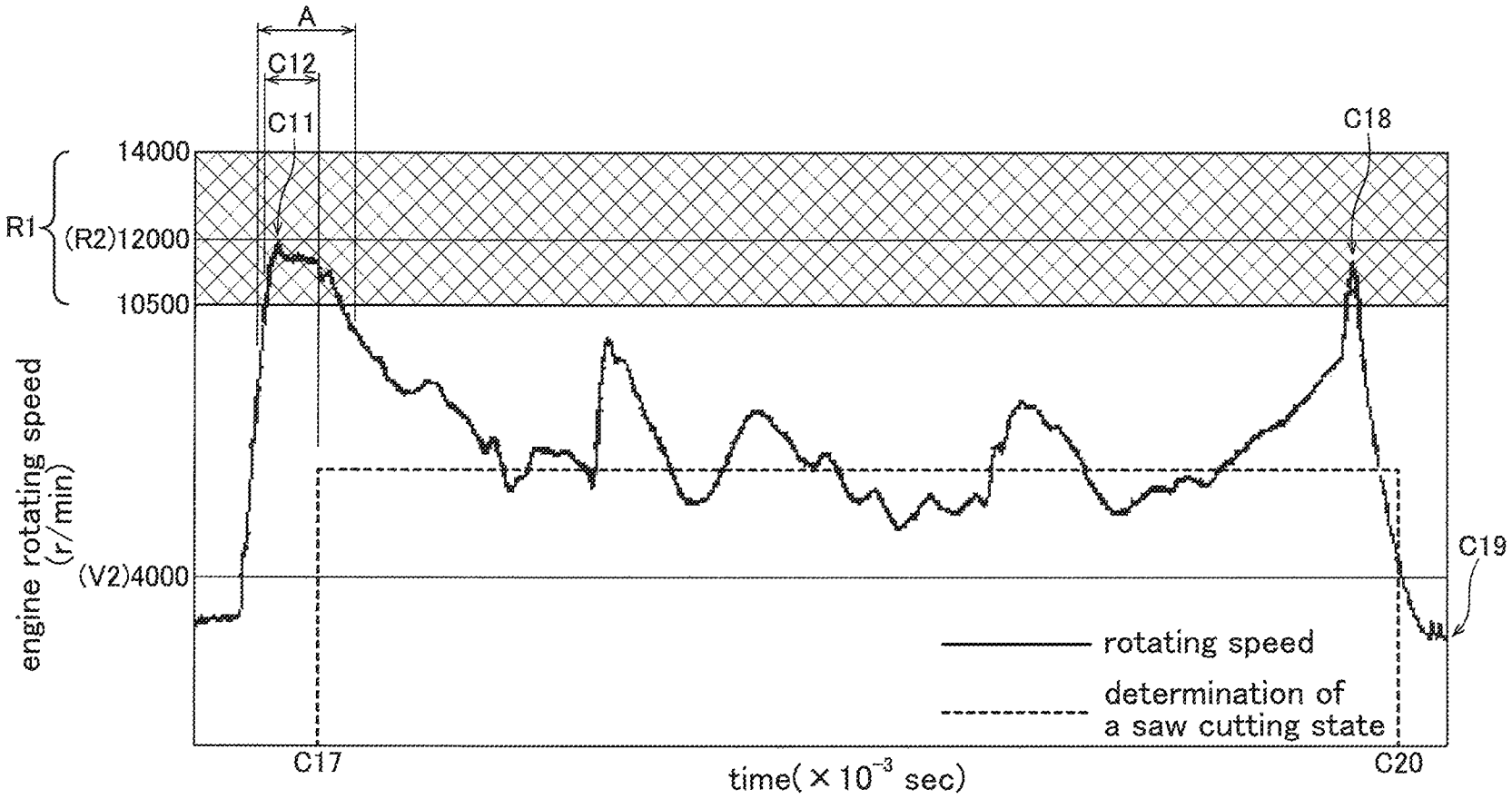
FIG. 4 is a graph showing an example of changes in the rotating speed with respect to time and determination of the saw cutting when an actual operation was performed with load by using a chain saw according to the present invention.
Figure 5:
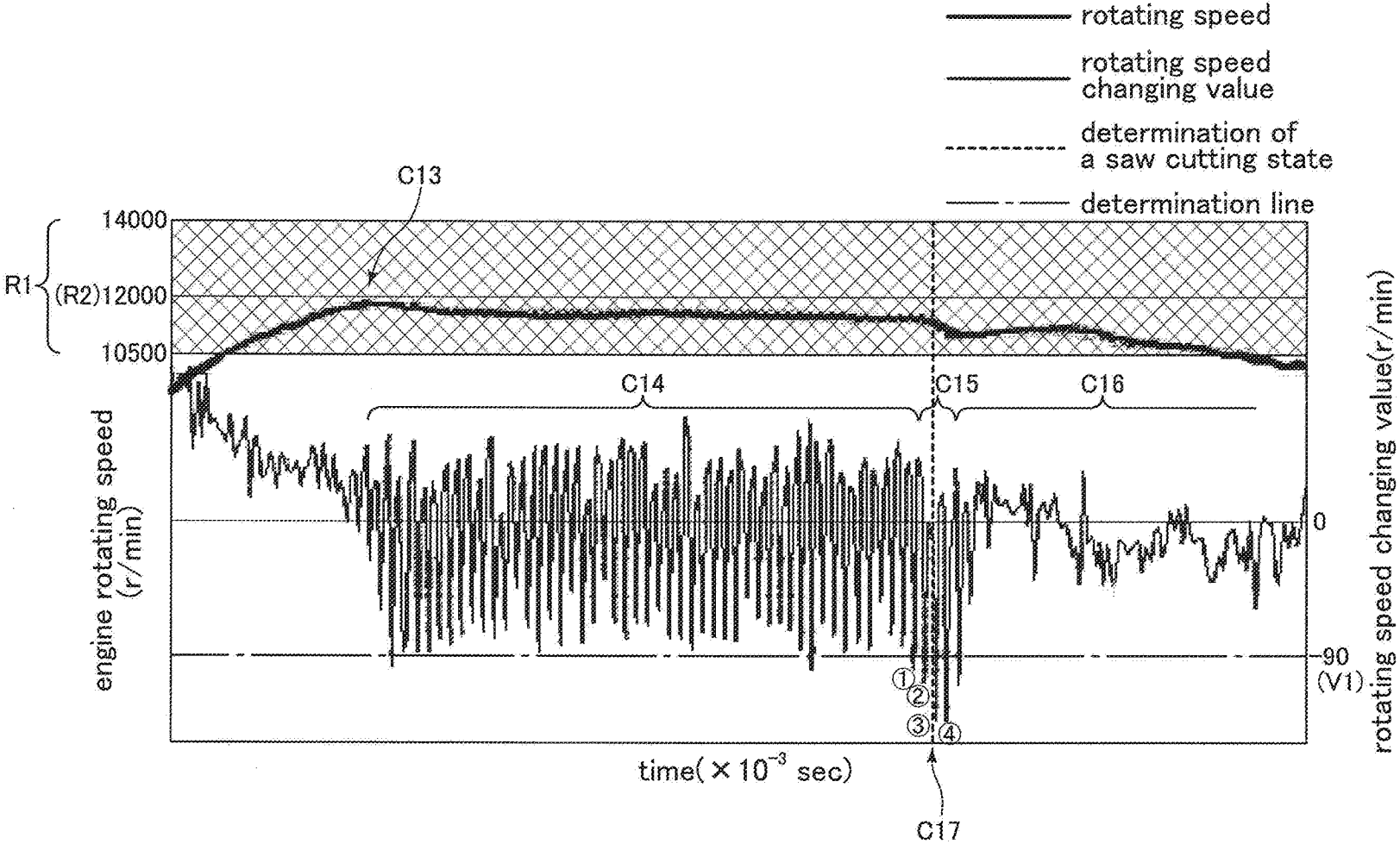
FIG. 5 is a graph showing the engine rotating speed and its changing value during a period A shown in FIG. 4.

FIG. 4 is a graph showing an example of changes is the rotating speed with respect to time and determination of the saw cutting state when an actual operation was performed with relatively large load by using a chain saw according to the present invention. FIG. 5 is a graph showing the engine rotating speed and its changing value during a period A shown in FIG. 4. The changing value of the engine rotating speed is a difference between the rotating speeds of the engine 12 per one rotation of the engine. Namely, when the rotating speed is faster than that in the previous rotation, the changing value is positive, and when the rotating speed is later than that in the previous rotation, the changing value is negative.

In FIG. 4, when the throttle was fully opened, the engine rotating speed was increased approximately to 12000 rpm (C11). When the rotating speed of the engine 12 was in the predetermined high rotating speed range R1 (10500-14000 rpm) and until the chain saw became in a saw cutting state explained later, the PI control was performed (C12). Namely, according to whether the rotating speed of the engine 12 was smaller or larger than the predetermined rotating speed 112 (for example, 12000 rpm), the control value is increased or decreased, respectively.

As shown in FIG. 5, when the throttle was fully opened, the chain saw 10 reached a fully-opened rotating speed with non-load (C13), and then, was operated at the rotating speed with non-load (C14). It has been found that when the chain saw 10 got started cutting wood and so on (with load) and the load was relatively large, the blades of the chain saw contacted an object to be saw cut so that the fluctuation of the changing value of the engine rotating speed became large toward a negative direction (C15), and then, the blades of the chain saw was moved into the object so that the blades of the chain saw became in a stable saw cutting state and the fluctuation of the changing value of the engine rotating speed became small (C16). During the period C15, when the changing value of the rotating speed of the engine per one rotation of the engine 12 became lower than a predetermined threshold value V1 (minus 90 rpm) more than a predetermined number of times (for example, three times) per a predetermined number of continuous rotations (for example, 10 rotations), it was determined that the chain saw 10 got started saw cutting (C17). The predetermined number of times per the predetermined times of continuous rotations and the predetermined threshold value V1 were appropriately defined so that whether or not the chain saw 10 got started saw cutting can be distinguished. After the determination of the starting of the saw cutting, the control of decreasing the control value so as to increase the opening degree of the solenoid valve 20 was maintained, but no control of increasing the control value so as to decrease the opening degree of the solenoid valve 20 was performed.

As shown in FIG. 4, after the finishing of the saw cutting, the engine rotating speed was increased, to approximately 12000 rpm (C18), and then, when the throttle was returned, the engine rotating speed was decreased to the idling rotating speed (C19). When the engine rotating speed was decreased blow a predetermined rotating speed V2 (for example, 4000 rpm), it was determined that the saw cutting was finished (C20).

Figure 6:
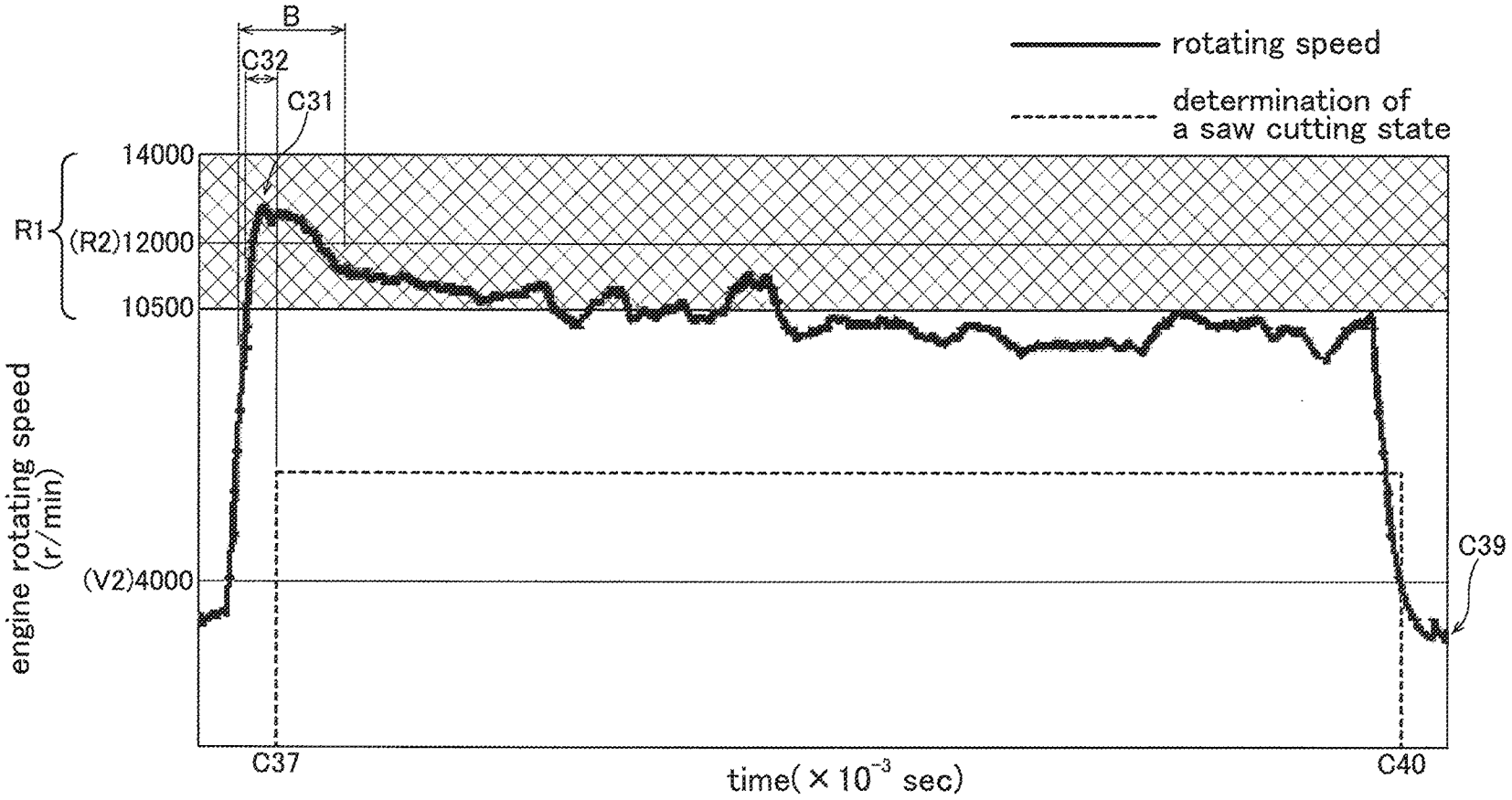
FIG. 6 is a graph showing an example of changes in the engine rotating speed with respect to time and determination of the saw cutting state when an actual operation was performed with load by using a chain saw according to the present invention.
Figure 7:
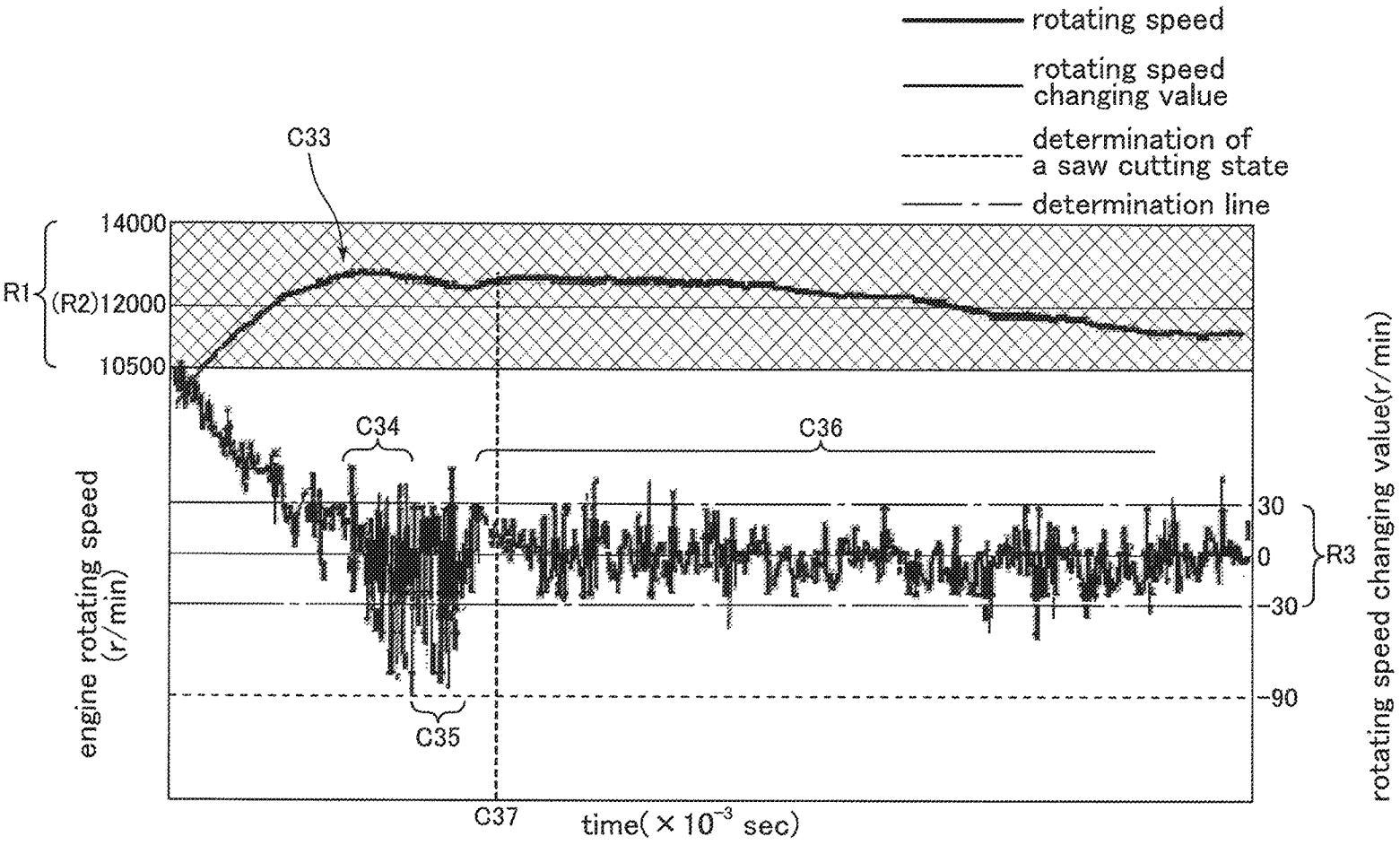
FIG. 7 is a graph showing the engine rotating speed and its changing value during a period B shown in FIG. 6.

FIG. 6 is a graph showing an example of changes in the engine rotating speed with respect to time and determination of the saw cutting state when the actual operation was performed with the chain saw according to the present invention with a relatively small load. FIG. 7 is a graph showing the engine rotating speed and its changing value during a period B shown in FIG. 6.

In FIG. 6, when the throttle is fully opened, the engine rotating speed was increased beyond 12000 rpm (C31). While the rotating speed of the engine 12 was within the predetermined high rotating speed range R1 (10500-14000 rpm) and until it became in a saw cutting state explained below, the PI control was performed (C32). Namely, according to whether the rotating speed of the engine 12 was smaller or larger than the predetermined rotating speed R2 (for example, 12000 rpm), the control value was increased or decreased, respectively.

As shown in FIG. 7, when the throttle was fully opened, the chain saw 10 reached the fully-opened rotating speed with non-load (C33), and then, was operated at the rotating speed with non-load (C34). When the chain saw 10 got started cutting wood and so on (with load) and the load is relatively small, the blades of the chain saw 10 contacted an object to be saw cut, but since the fluctuation of the changing value of the engine rotating speed toward a negative direction was smaller than that in FIG. 5 (C35), it was not possible to determine whether or not the chain saw 10 got started saw cutting in the same way as that explained referring to FIG. 5. Then, it has been found that at the same time the blades of the chain saw 10 out into the object, the chain saw became in a stable saw cutting state and the fluctuation of the changing value of the engine rotating speed became small. In a period C36, when the changing value of the rotating speed per one rotation of the engine 12 is within a predetermined range R3 (for example, ±30 rpm) more than a predetermined number of times (for example, 10 times) per a predetermined number of times of continuous rotations (for example, 10 rotations), it was determined that the chain saw 10 got started saw cutting (C37). The predetermined number of times per the predetermined number of continuous rotations is appropriately defined so that whether or not the chain saw 10 got started saw cutting can be distinguished. After the determination of the starting of the saw cutting, the control of decreasing the control value so as to increasing the opening degree of the solenoid valve 20 was maintained, but no control of increasing the control value so as to decrease the opening degree of the solenoid valve 20 was performed.

As shown in FIG. 6, after the finishing of the saw cutting and then, when the throttle was returned, the engine rotating speed was decreased to the idling rotating speed (C39). When the engine rotating speed was decreased below the predetermined rotating speed V2 (for example, 4000 rpm), it was determined that the chain saw 10 is not in the saw cutting state (C40).

Figure 8:
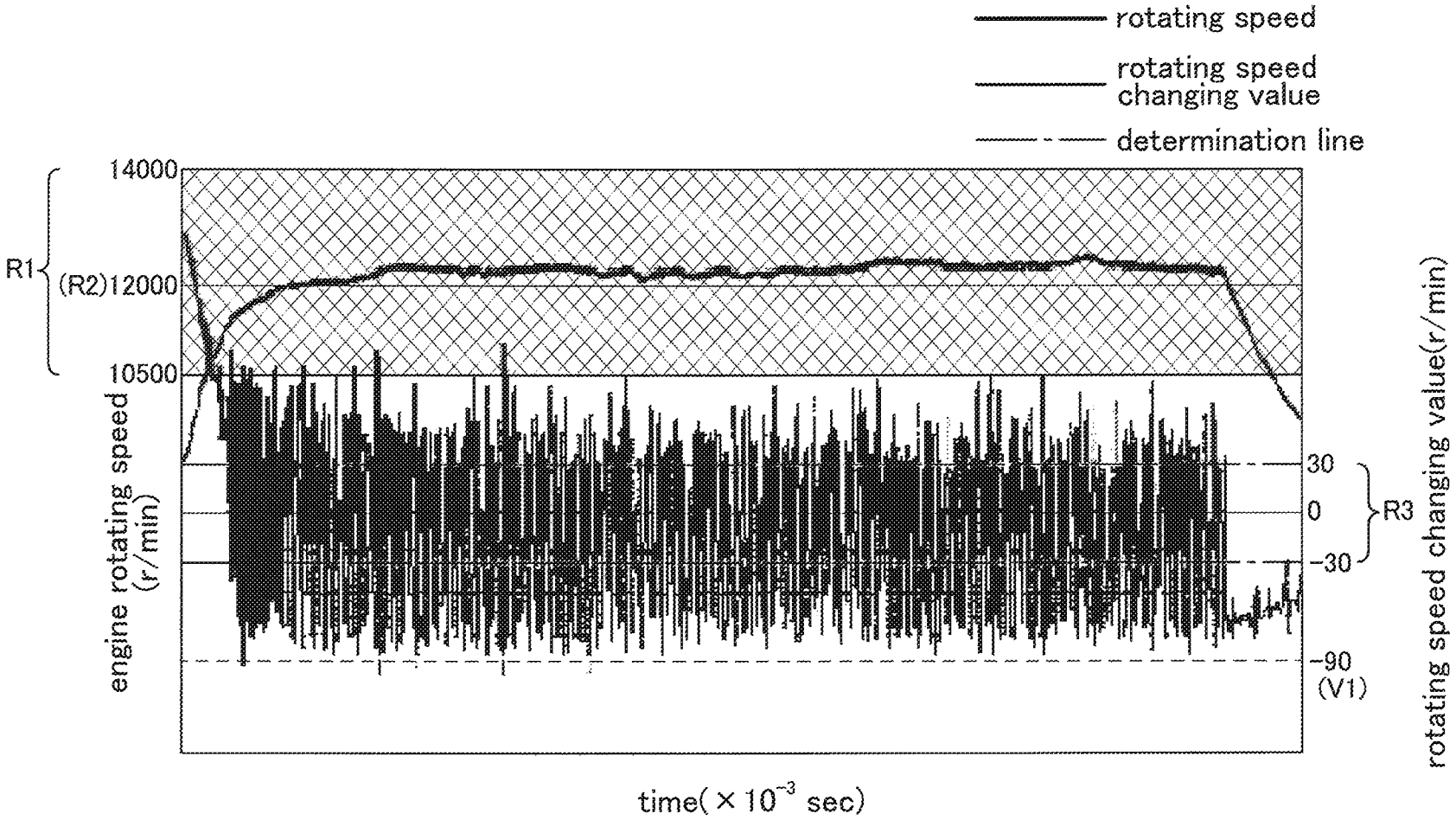
FIG. 8 is a graph showing the engine rotating speed and its changing value when the actual operation was performed with non-load.
Figure 9:
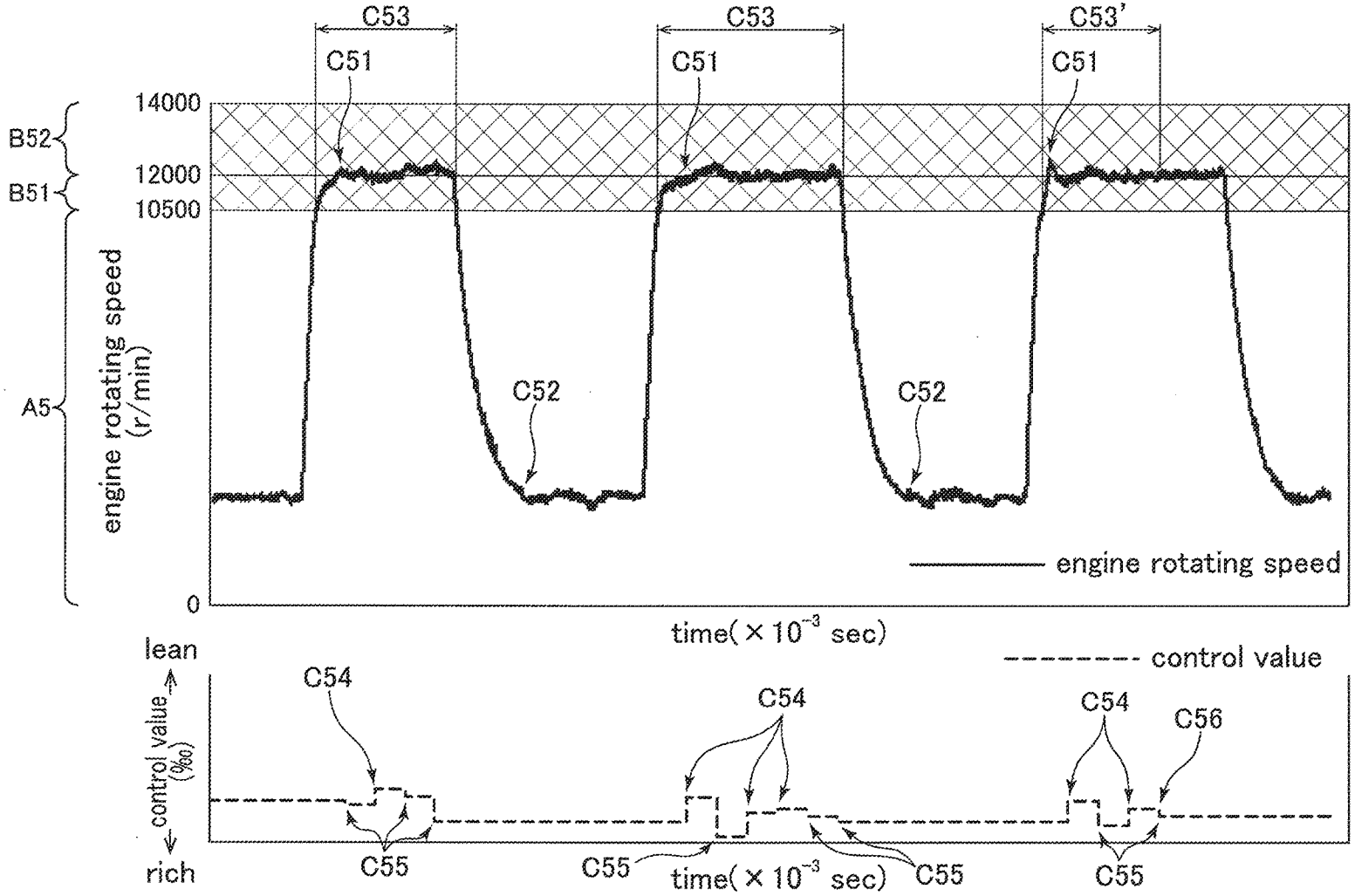
FIG. 9 is a graph showing changes in the engine rotating speed and the control value with respect to time around a time when the actual operation control value was determined in an example in which an actual operation with non-load of the chain saw was performed while the control described in the Patent Publication 1 was performed.
Figure 10:
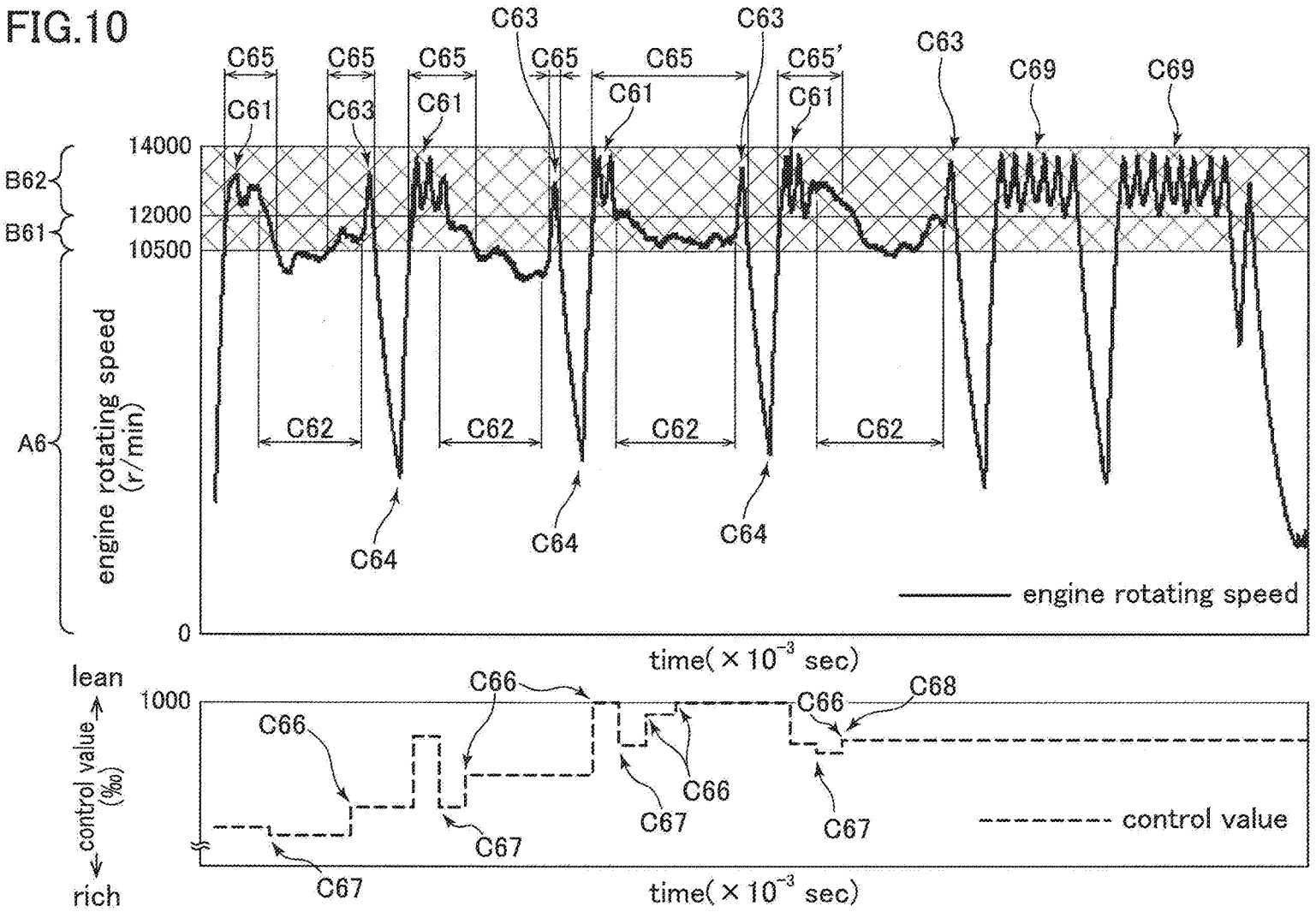
FIG. 10 is a graph showing changes in the engine rotating speed and the control value with respect to time around a time when the actual operation control value was determined in an example in which an actual operation with load of the chain saw was performed while the control described in the Patent Publication 1 was performed.

FIG. 8 is a graph showing the engine rotating speed and its changing value when the actual operation was performed with non-load.

As can be seen from FIG. 8, the changing value of the rotating speed of the engine was not within a predetermined value range R3 (for example, ±30 rpm) and was larger than the predetermined threshold value V2 (for example, minus 90 rpm). Thus, the predetermined value range R3 and the predetermined threshold value V2 can be a reference for determining whether or not the chain saw is in the saw cutting state.

As stated above, whether or not the chain saw gets started cutting is determined, and after the starting of the saw cutting, the control of decreasing the control value can be performed so as to increase the opening degree of the solenoid valve 20, but no control of increasing the control value is performed so as to decreasing the opening degree of the solenoid valve 20, so that the actual operation control value of the chain saw according to the present invention can be made closer to the actual operation control value to be determined with non-load than the actual operation control value of the chain saw according to prior art. Thus, the chain saw according to the present invention does not provide an operator with uncomfortable feeling due to the fluctuation of rotation.

Although an embodiment of the present invention has been explained, the present invention is not limited to the embodiment, namely, many kinds of modifications can be done within the scope of the present invention, and it goes without saying that such modifications fall within the scope of the present invention.

What is claimed:

1. An engine-driven working machine comprising:

an engine including an electronically controlled carburetor; and a controller connected to the electronically controlled carburetor;

wherein the electronically controlled carburetor includes a solenoid valve for adjusting an amount of fuel supplied to the electronically controlled carburetor, wherein the controller is configured to determine whether or not the working machine is in a load state;

wherein the controller is configured to vary a control value of the solenoid valve so as to increase an opening degree of the solenoid valve when a rotating speed of the engine is within a predetermined high rotating speed range, the working machine is not in the load state, and the rotating speed of the engine is higher than a target rotating speed, wherein the controller is configured to vary the control value of the solenoid valve so as to decrease the opening degree of the solenoid valve when the rotating speed of the engine is within the predetermined high rotating speed range, the working machine is not in the load state, and the rotating speed of the engine is lower than the target rotating speed, and wherein the controller is not configured to vary the control value of the solenoid valve when the rotating speed of the engine is within the predetermined high rotating speed range, the working machine is in the load state, and the rotating speed of the engine is lower than the target rotating speed.

2. The engine-driven working machine according to claim 1, wherein the controller is configured to vary the control value of the solenoid valve so as to increase the opening degree of the solenoid valve when the rotating speed of the engine is within the predetermined high rotating speed range, the working machine is in the load state, and the rotating speed of the engine is higher than the target rotating speed.

3. The engine-driven working machine according to claim 1, wherein the controller determines that the engine-driven working machine enters the load state when a changing value of the rotating speed of the engine for one rotation of the engine is lower than a predetermined threshold value more than a predetermined number of times per a predetermined number of continuous rotations.

4. The engine-driven working machine according to claim 1, wherein the controller determines that the engine-driven working machine enters the load state when a changing value of the rotating speed of the engine for one rotation of the engine is within a predetermined range more than a predetermined number of times per a predetermined number of continuous rotations.

5. The engine-driven working machine according to claim 1, wherein the engine-driven working machine is a chain saw, an engine cutter or a hedge trimmer.

* * * * *